United States Patent [19]

Read

[11] Patent Number: 4,508,173

[45] Date of Patent: Apr. 2, 1985

[54] FLOW CONTROL VALVE FOR USE ON OIL AND GAS WELLS OR THE LIKE

[75] Inventor: Norman W. Read, Dallas, Tex.

[73] Assignee: Dresser Industries, Inc., Dallas, Tex.

[21] Appl. No.: 536,465

[22] Filed: Sep. 26, 1983

[51] Int. Cl.[3] ..... E21B 34/12

[52] U.S. Cl. ..... 166/330; 251/160; 251/283; 251/315

[58] Field of Search ..... 166/330, 331, 324; 251/352, 315, 159, 160, 283

[56] References Cited

U.S. PATENT DOCUMENTS

| | | | |
|---|---|---|---|
| 3,007,669 | 11/1961 | Fredd | 251/31 |
| 3,386,701 | 6/1968 | Potts | 251/229 |
| 3,398,928 | 3/1911 | Fredd | 251/251 |
| 3,414,061 | 12/1968 | Nutter | 166/226 |
| 3,993,136 | 11/1976 | Mott | 166/324 X |
| 4,210,207 | 6/1980 | McStravick et al. | 166/330 |
| 4,270,606 | 6/1981 | McStravick et al. | 166/181 |
| 4,293,038 | 10/1981 | Evans | 166/331 |
| 4,332,267 | 6/1982 | Evans | 137/1 |
| 4,415,038 | 11/1983 | Schmuck | 166/324 X |

*Primary Examiner*—Stephen J. Novosad
*Assistant Examiner*—Michael Starinsky
*Attorney, Agent, or Firm*—William R. Peoples

[57] ABSTRACT

The valve includes a tubular housing member that is connected in a string of a tubing that extends into an oil or gas well. The upper end of the tubular housing member is rotatable and is connected through actuators to a valve member that is pivotally supported in the tubular housing member. Rotation of the upper end of the tubular housing causes the actuators to move linearly and in opposite directions simultaneously pivot the valve member between open and closed positions. Pressure responsive means bias the seat toward the valve to maintain a fluid tight seal regardless of the direction of differential in pressure existing across the valve.

9 Claims, 9 Drawing Figures

FLOW CONTROL VALVE FOR USE ON OIL AND GAS WELLS OR THE LIKE

BACKGROUND OF THE INVENTION

This invention relates generally to an improved valve for use in oil and gas wells or the like. More specifically, but not by way of limitation, this invention relates to a flow control valve including a valve member that is caused to move between the open and close positions by rotation of the tubing.

In operations performed in oil and gas wells or the like, it is desirable to be able to provide as large a flow path through a tool situated in the well as is possible while still maintaining the functional integrity of the tool. Valves, particularly ball valves, provide a relatively large flow path through the housing in which they are contained. Further, it is desirable to be able to provide, when the valve is closed, a fluid tight seal preventing flow through the tool. Again, ball valves are particularly adapted to such situations since the sealing structure is annular in configuration and is therefor relatively simple to construct.

A relatively large number of U.S. patents have issued providing various apparatus for utilizing valves of the ball type in tools lowered into oil and gas wells. Some of these valves function adequately and provide fluid tight seals in the event that the fluid pressure differential across the valve is in one direction only. Insofar as is known, there are no present ball valves that are effective to maintain the fluid tight seal regardless of whether the pressure differential exists across the valve from above to below or from below to above.

It is therefore, one object of this invention to provide an improved valve, generally of the ball type, that is located in a tool arranged to be lowered into a wellbore, that is moved between open and closed positions by rotation of the well tubing.

It is a further object of the invention to provide such a valve that is capable of maintaining a fluid tight seal regardless of the direction of differential in pressure existing across the valve.

SUMMARY OF THE INVENTION

This invention provides an improved flow control valve for use in oil and gas wells or the like. The valve comprises a tubular housing member having first and second ends and includes means connected to the first end for rotating the first end and for connection to a tubing string positioned in the well. The valve also includes a valve member having a flow passage therethrough that is pivotally supported in the tubular housing member. First and second valve actuators are located in the housing member and each has one end connected to the rotatable means and the opposite end connected to the valve member, whereby rotation of the rotatable means causes linear movement of the actuators in relatively opposite directions causing pivoting of the valve member between open and closed positions.

BRIEF DESCRIPTION OF THE DRAWING

The foregoing and additional objects and advantages of the invention will become more apparent when the following detailed description is read in conjunction with the accompanying drawing, wherein like reference characters denote like parts in all views, and wherein.

DETAILED DESCRIPTION OF THE PREFERRED EMBODIMENT

Figure 1:
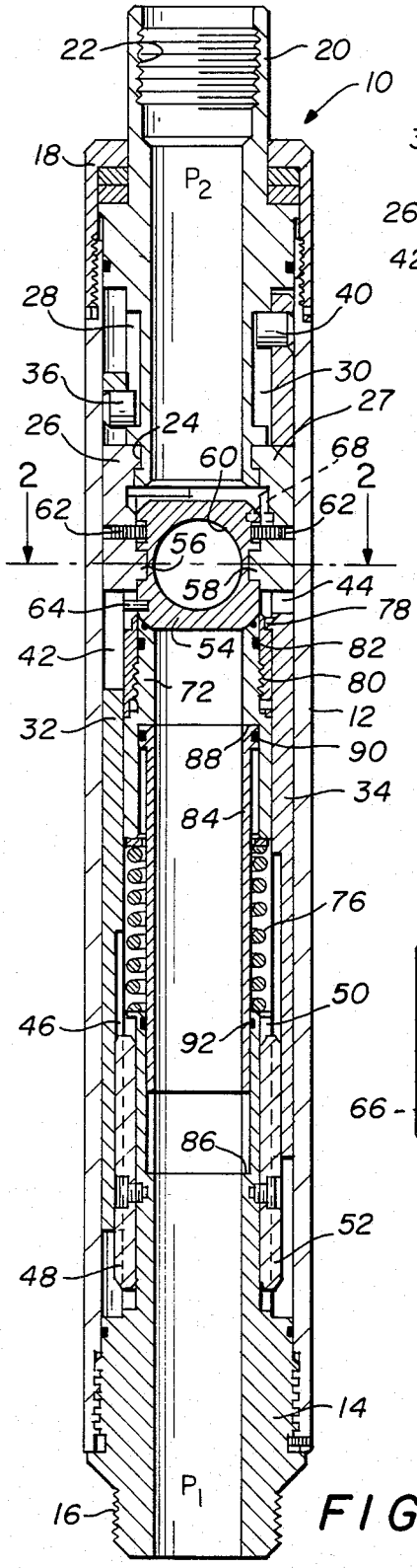
FIG. 1 is a cross-sectional view of a valve constructed in accordance with the invention.
Figure 2:
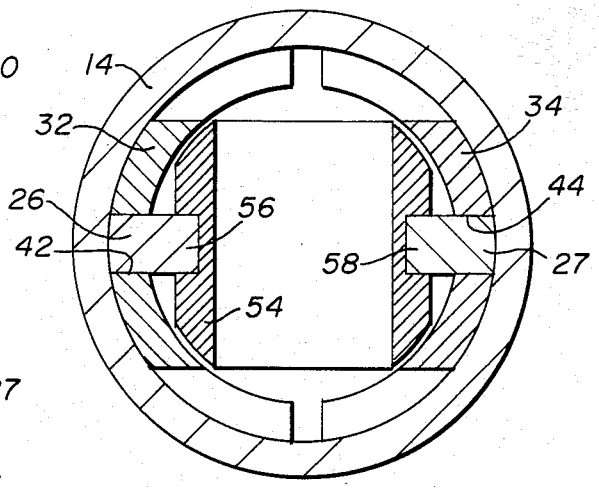
FIG. 2 is an enlarged cross-sectional view taken generally along the line 2—2 of FIG. 1.

Referring to the drawing and to FIG. 1 in particular, shown therein and generally designated by the reference character 10, is an improved flow control valve for use in oil and gas wells or the like that is constructed in accordance with the invention. The valve 10 includes a hollow tubular housing 12 that is threadedly connected with a lower sub 14 that is provided on its exposed exterior end with threads 16 by which valve 10 is connected into a tubing string (not shown). The upper end of the tubular housing 12 is provided a swivel connection 18 which permits a swivel member 20 to rotate relative to the housing 12 for purposes that will become more apparent hereinafter.

Figure 7:
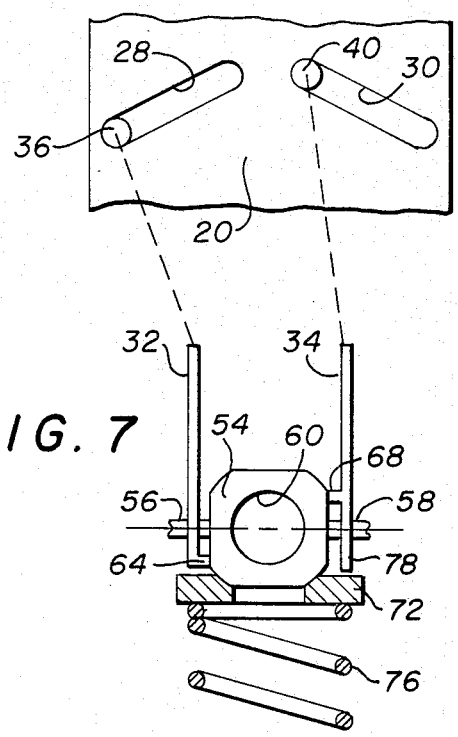
FIGS. 7, 8 and 9 are schematic views illustrating the valve member and the valve seat in various operating positions.
Figure 8:
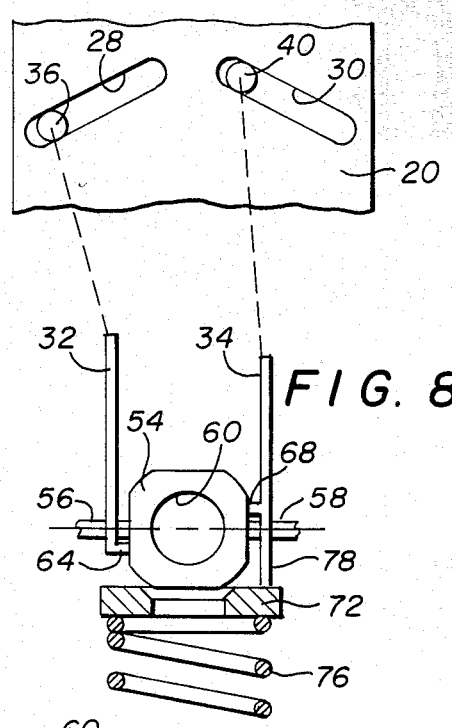
Figure 9:
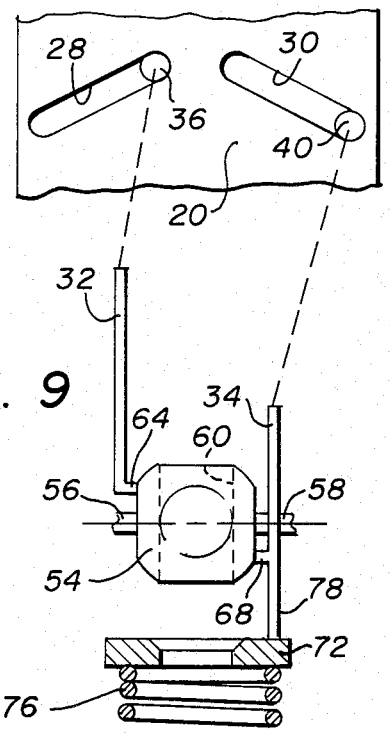

At its uppermost end, the swivel member 20 is provided with threads 22 suitable for connecting the upper end of the valve 10 into the tubing string. At its lowermost end, the swivel connection 18 includes an annular groove 24 for receiving the uppermost ends of a pair of diametrically opposed valve member pivots 26 and 27. The arrangement is such that the distance from the valve member pivots to the upper end of the housing 12 is fixed, but so that the swivel member 20 can rotate in the housing 12 relative to the pivots 26 and 27. Intermediate the ends of the swivel member 20, there are provided diametrically spaced slots 28 and 30. The slots are relatively short and generally helical in configuration fashion. In layout, the slots are shown in FIGS. 7, 8 and 9.

It will be noted in FIG. 1 that the exterior diameter of the swivel member 20 is reduced providing an annular space between the member 20 and the housing 12 into which there is fitted a sliding valve actuating member 32 on the left side as seen in FIG. 1, and a sliding valve actuating member 34 on the right side as seen in FIG. 1. The valve actuating member 32 carries a pin 36 that is positioned in the lower part of slot 28 and the valve member 34 carries a pin 40 that is positioned in the upper part of slot 30. Accordingly, rotation of the swivel member 20 relative to the housing 12, causes the pins 36 and 40 to move longitudinally of the housing 12 in the slots 28 and 30, and as can be appreciated from viewing FIGS. 8 and 9, to move simultaneously in opposite directions.

The valve actuating member 32 also includes a slot 42 which encompasses the valve member pivot 26 and similarly, the valve operating member 34 includes a slot 44 that encompasses the valve member pivot 27.

The valve actuating member 32 extends downwardly into the lower end of the housing 12, and is provided with a plurality of spline members 46 that are in operative engagement with a plurality of splines 48 located on the sub 14. Similarly, the valve actuating member 34 is provided with a plurality of splines 50 at its lower end in engagement with a plurality of spline members 52, which are also located on the sub 14. The splines 46, 48, 50 and 52 function to maintain the longitudinal or axial movement of the valve actuating members 32 and 34 relative to the housing 12 upon rotation of the swivel member 20.

A valve member 54 is illustrated in FIG. 1 as being in the closed position is pivotally located in the housing 12. The valve member, although illustrated as being foreshortened on some of the sides, is of the ball type and generally spherical in configuration. The valve member 54 is carried by the valve member pivots 26 and 27 and pivots about a pair of pivot pins 56 and 58 located thereon. The valve member 54 is pivotal between the closed position as shown, wherein the flow passageway 60 extending therethrough being in alignment with the longitudinal axis of the valve is not in alignment with the axis of the valve 10, to an open position that can be seen in FIG. 9, wherein the passageway 60 is in alignment with the longitudinal axis of the valve 10.

To prevent over rotation of the valve member 54, stop pins 62 project from the valve member pivots 26 and 27 into a 90° slot 63 formed on each side of the valve member 54. (The slots may be more clearly seen in FIGS. 4, 5 and 6.)

Figure 6:
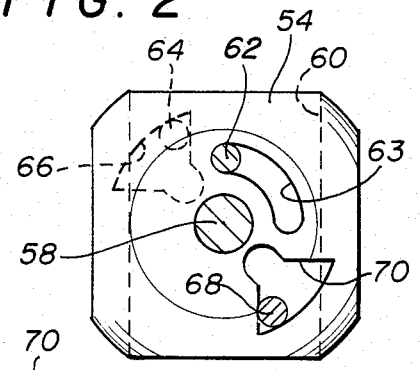
FIGS. 4, 5 and 6 are side views of the valve member removed from the valve of FIG. 1, and illustrated in various operating positions.
Figure 5:
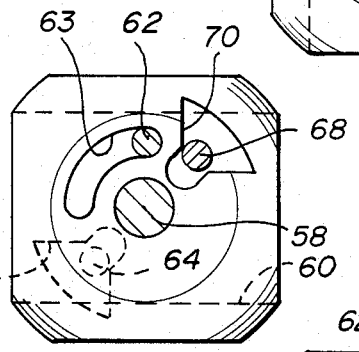
Figure 4:
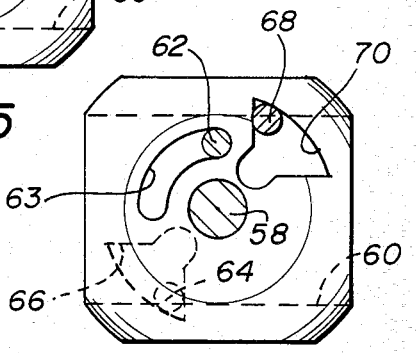

The actuating member 32 carries an actuating pin 64 that is disposed in a dovetail shaped lost motion groove 66 (see FIGS. 4, 5 and 6). Similarly, the actuating member 34 is provided with a valve actuating pin 68 shown in dotted lines in FIG. 1. The pin 68 is disposed in an identical but oppositely disposed dovetail lost motion groove 70 in the valve member 54. The opposite positions of actuating pins 64 and 68 is to place a couple on the valve member 54 in response to longitudinal movement of the valve actuating members 32 and 34 to pivot the valve member 54 from the open to the closed position and viceversa. The purpose of lost motion grooves 66 and 70 will become more apparent during the operational description of the valve.

In order to provide a fluid tight seal in the valve 10, it is necessary the sealing surface of the valve member 54 be sealingly engaged by or sealingly engageable with a valve seat which is identified by the reference character 72. As shown more clearly on the enlarged FIG. 3, the valve seat 72 includes a resilient annular seal member 74 that is arranged to sealingly engage the surface of the valve member 54. The valve seat 72 is generally annular in configuration and forms within the housing 12 a member that is movable axially thereof in response to urging of a compression spring 76 that continually biases the seat toward engagement with the valve member 54.

It has been observed in the past that damage to a valve seat may occur during rotation of the valve member, when engaged with the valve seat, if a substantial amount of pressure is applied across the valve. Therefore, the valve operating member 34 has been provided with a lug 78 that is in engagement with an annular member 80 that is threadedly attached to the exterior of the valve seat 72. A resilient, O-ring seal 82 is provided between the member 80 and the valve seat 72 for pressure control purposes as will be explained more fully hereinafter.

Slidingly disposed within the bore of the seat 72 is an annular balance piston 84 that is free to travel axially within the valve 10 between an upwardly facting shoulder 86 located in the interior of the lower sub 14, and a downwardly facing shoulder 88 formed in the valve seat 72. The balance piston 84 carries an O-ring seal 90 in its upper end that slidingly and sealingly engages the interior of the seat 72. A second O-ring seal 92 is located in the sub 14 in sliding and sealing engagement with the exterior of the balance piston 84.

OPERATION OF VALVE 10

Having just discussed the structural arrangement of the valve seat 72, and various seals related thereto, it should be pointed out that valve 10 is designed so that regardless whether a pressure differential exists from above the valve to below the valve, wherein P2 would be greater than P1, or from below the valve to above the valve wherein the pressure P1 would be greater than pressure P2, an upward net force will always be applied on the valve seat 72 attempting to move into tighter sealing engagement with valve member 54.

Figure 3:
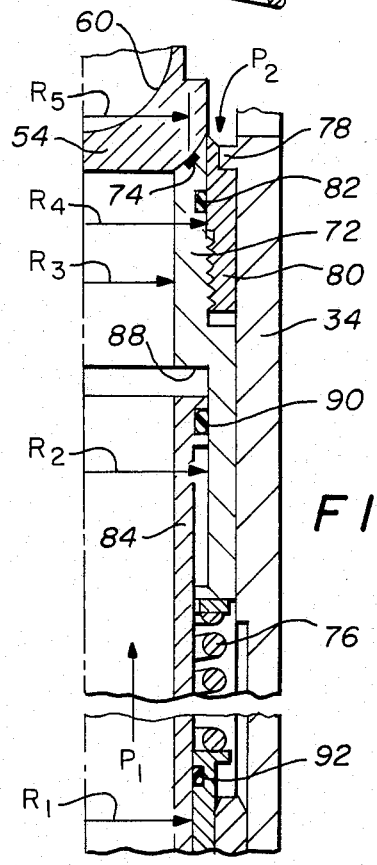
FIG. 3 is an enlarged, fragmentary cross-sectional view of a portion of the valve of FIG. 1.

Referring to FIG. 3 where the structure of the seal arrangement is shown in more detail, the effective radii of the various seals and bores have been designated generally by the reference characters R1, R2, R3, R4 and R5, for the seal 92, seal 90, interior bore of seat 72, the seal 82 and the seal 74, respectively.

Assuming first that the pressure P1 below the valve member 54 is greater, that is, that the greater pressure is from below, pressure is applied upwardly through the interior of the housing 12 forcing the balance piston 84 downwardly until it engages the shoulder 86. When this occurs, the upward force on the valve seat 72 is determined by the areas corresponding to radii as R2–R3. There will also be a downward force exerted, which is determined by the areas corresponding to the radius R5 minus the radius R3. Since the area corresponding to R2–R3 is greater than the area corresponding to R5–R3, the force resulting from P1 will be in the upward direction.

Assuming that the pressure P2 is greater than P1, then such pressure will migrate around the valve member 54 and the exterior of the valve seat 72, causing a downward force on the valve seat 72, which will be due to the pressure applied to the area corresponding to the difference between radii R4 and R5. However, also note that such pressure (P2) is applied upwardly on the exterior of the balance piston 84 driving the balance piston 84 upwardly until it engages the shoulder 88. When this occurs, the upward force acting on the valve seat 72, will be determined by the area corresponding to the difference between the radii R2 and R1. Since R2–R1 is greater than R5–R4, the force resulting from the pressure P2 is also going to be in the upward direction. Thus, it can be appreciated that without any modifications to the valve 10, and when the valve member 54 is in the closed position, the valve seat 72 is biased toward the valve member 54 regardless of direction of differential pressure across the valve.

For a fuller understanding of the operation of the mechanical portions of the valve 10, please refer to FIGS. 4, 5 and 6 in conjunction with FIGS. 7, 8 and 9. As previously mentioned, the valve member 54 is illustrated in FIG. 1 and also in FIG. 7, as being in the closed positions. Also, as previously mentioned, it is desirable to move the valve seat 72 away from the valve member 54 prior to operating or pivoting the valve member 54 to avoid damage to the seat or the seal 74 carried thereby.

To move the valve seat 72 away from the valve member 54, partial rotation of the swivel member 20 occurs relative to tool 10. Such movement is illustrated as occurring by moving the swivel member 20 from the position illustrated in FIG. 7 to the position illustrated in FIG. 8. As shown therein, the left valve actuating member 32 is starting to move upward slightly in slot 28 and the right valve actuating member 34 starts to move downwardly slightly in the slot 30. The lug 78, carried by the valve actuating member 34, is in engagement with the seat 72. Since the valve actuating member 34 is moving downwardly, the seat 72 is pressed away from the valve member 54 as illustrated in FIG. 8. To understand why the ball valve member 54 does not rotate during this motion, please refer to FIGS. 4 and 5.

As illustrated in FIG. 4, the valve member 54 is in the fully closed position and the actuating pin 68 on the member 34 is illustrated as being in the uppermost portion of the dovetail groove 70. As the swivel member 20 rotates moving pins 36 and 40 in slots 28 and 30 from the positions illustrated in FIG. 7 to the positions illustrated in FIG. 8, the actuating pin 68 moves from the position illustrated in FIG. 4 to the position illustrated in FIG. 5. Thus, it can be seen that the pin 68 is moving within the dovetail groove 70 and does not engage any portion of the valve member 54 which could result in a pivotal movement of the valve member 54. Thus, there is provided an initial pivotal movement of the member 20 to move the valve seat 72 away from the valve member 54 without having pivotal movement of the valve member 54 toward the open position from the closed position.

Further rotational movement of the swivel member 20 moves the various portions of the valve 10 to the positions illustrated in FIG. 9. It can be seen in this position that the valve seat 72 is well clear the valve member 54, and that the actuating pins 64 and 68 have engaged valve member 54 to pivot it about the pivot pins 56 and 58. Also, with reference to FIG. 6, it can be seen that the actuating pin 68 has moved into engagement with the side of the valve member 54 in the groove 70 and caused the valve member 54 to pivot about the pin 58. As previously mentioned, over rotation of the valve member 54 is prevented by the stop pins 27 operating in the 90° arcuate grooves 63 engaging the valve member 54.

To reclose the valve 10, rotation of the swivel member 20 is made in the opposite direction and the procedure occurs just as described, but, of course, in the opposite direction.

With the foregoing detailed description, it can be seen that the valve described in detail herein is one that is controlled by rotational movement, one in which the valve seat is moved away from the valve prior to moving from the closed to the open position to avoid damage to the valve seats, and one in which the valve will hold pressure, when in the closed position, against a pressure differential existing in either direction across the valve.

The foregoing detailed description has been presented by way of example only, and it will be understood that there can be many changes and modifications made without departing from the spirit and scope of the invention.

The embodiments of the invention in which an exclusive property or privilege is claimed are defined as follows:

1. A flow control valve for use in oil and gas wells and the like, said valve comprising:

a tubular housing member having first and second ends;

rotatable means connected for rotation to said first end and adapted to be connected to a tubing string positioned in said well;

a valve member having a flow passageway extending therethrough pivotally supported in said tubular housing member for movement between open and closed positions;

first and second valve actuators each having one end operably connected to said rotatable means and located in said housing member, and being movable therein linearly and in opposite directions simultaneously upon rotation of said rotatable means; and, groove and pin means for connecting between the other ends of said valve actuators and said valve member on opposite sides thereof and forming a force couple to pivot said valve member between said positions when rotating said rotatable means regardless of the linear directions of travel of said actuators.

2. The valve of claim 1, wherein said valve member is generally spherical in configuration.

3. The valve of claim 1 and also including:

an annular valve seat located in said housing member adjacent and sealingly engageable with said valve member;

resilient means in said housing member biasing said annular valve seat toward said valve member; and seat engaging means on one of said valve actuators, for engaging said seat to move said seat away from said valve member when said valve member is pivoted to the closed position.

4. The valve of claim 3 wherein said seat engaging means engages and moves said seat out of engagement with said valve member prior to rotation of said valve member to said open position.

5. The valve of claim 4 and also including pressure responsive means in said tubular housing member for biasing said seat toward said valve member when said valve member is in the closed position in response to a differential in pressure between the first and second ends of said housing member and regardless of the direction of such differential, whereby said valve prevents flow through said housing member in either direction.

6. The valve of claim 5 wherein said pressure responsive means includes:

seal means on said seat and on said housing member for defining areas on said seat facing said valve member and for defining areas on said seat facing away from said valve member that are larger than said first mentioned areas; and, fluid passageway means in said valve for introducing pressure from each end of said housing members on each of said areas whereby said seat is biased toward said valve member by the resultant force generated by said pressures acting on the larger areas facing away from said valve member.

7. A flow control valve for use in oil and gas wells and the like, said valve comprising:

a tubular housing member having first and second ends;

rotatable means connected for rotation to said first end and adapted to be connected to a tubing string positioned in said well;

a valve member having a flow passageway extending therethrough pivotally supported in said tubular housing member for movement between open and closed positions;

first and second valve actuators each having one end operably connected to said rotatable means and located in said housing member, and being movable therein linearly and in opposite directions simultaneously upon rotation of said rotation means, said actuators having the other end of each operably connected to said valve member, whereby rotation of said rotation means pivots said valve member between said positions;

an annular valve seat located in said housing member adjacent and sealingly engageable with said valve member;

resilient means in said housing member biasing said annular valve seat toward said valve member;

seat engaging means on one of said valve actuators, for engaging said seat to move said seat away from said valve member when said valve member is pivoted to the closed position, said seat engaging means engaging and moving said seat out of engagement with said valve member prior to rotation of said valve member to said open position; and, pressure responsive means in said tubular housing member for biasing said seat toward said valve member when said valve member is in the closed position in response to a differential in pressure between the first and second ends of said housing member and regardless of the direction of such differential, whereby said valve prevents flow through said housing member in either direction, said pressure responsive means being located between said valve member and the second end of said housing member and including:

an annular seal carried by said seat in sealing engagement with said valve member when said valve member is in the closed position defining first and second annular surfaces facing said valve member;

said seat includes a seal bore and has a seal therein having a diameter larger than said annular seal providing an annular shoulder facing said second end having an area larger than the area of said first annular surface facing said valve member, whereby pressure at said second end biases said seat toward said valve member due to the difference in said areas; and, said tubular housing member includes a seal bore adjacent to said second end and has a seal member therein having a diameter smaller than the diameter of said annular seal and defining an area on said seat facing said second end that is greater than the said second annular surface facing said valve member, whereby pressure at said first end biases said seat toward said valve member due to the difference in said areas.

8. A flow control valve for use in oil and gas wells and the like, said valve comprising:

a tubular housing member having first and second end adapted for connecting said valve in a tubing string positioned in said well;

a valve member having a flow passageway extending therethrough pivotally supported in said housing member for movement between open and closed positions;

means located in said housing member for pivoting said valve member between said positions;

an annular valve seat movably located in said housing and engageable with said valve member, said seat being movable into engagement with said valve member when said valve member is in the closed position, said seat being out of engagement with said valve member when said valve member is in the open position;

means for moving and retaining said seat out of engagement with said valve member;

means for resiliently urging said seat toward said valve member;

pressure responsive means for biasing said seat toward said valve member when a differential in pressure exists in said housing member between the first and second ends thereof and when said valve member is in the closed position regardless of the direction of such differential in pressure, whereby said valve, when closed, prevents flow in either direction therethrough, said pressure responsive means being located between said valve member and the second end of said housing member and including:

an annular seal carried by said seat in sealing engagement with said valve member when said valve member is in the closed position defining first and second annular surfaces facing said valve member;

said seat includes a seal bore and has a seal therein having a diameter larger than said annular seal providing an annular shoulder facing said second end having an area larger than the area of said first annular surface facing said valve member, whereby pressure at said second end biases said seat toward said valve member due to the difference in said areas; and, said tubular housing member includes a seal bore adjacent to said second end and has a seal member therein having a diameter smaller than the diameter of said annular seal and defining an area on said seat facing said second end that is greater than the said second annular surface facing said valve member, whereby pressure at said first end biases said seat toward said valve member due to the difference in said areas.

9. A flow control valve for use in oil and gas wells and the like, said valve comprising:

a tubular housing member having first and second ends adapted for connecting said valve in a tubing string positioned in said well;

a valve member having a flow passageway extending therethrough pivotally supported in said housing member for movement between open and closed positions;

means located in said housing member for pivoting said valve member between said positions including:

rotatable means connected for rotation to said first end and adapted to be connected to the tubing string, first and second valve actuators each having one end operably connected to said rotatable means and located in said housing member, and being movable therein linearly and in opposite directions simultaneously upon rotation of said rotation means; and, groove and pin means for connecting between the other ends of said valve actuators and said valve member on opposite sides thereof and forming a force couple to pivot said valve member between said positions when rotating said rotatable means regardless of the linear directions of travel of said actuators;

an annular valve seat located in said housing and engageable with said valve member;

means for resiliently urging said seat toward said valve member; and, pressure responsive means for biasing said seat toward said valve member when a differential in pressure exists in said housing member between the first and second ends thereof and when said valve member is in the closed position regardless of the direction of such differential in pressure, whereby said valve, when closed, prevents flow in either direction therethrough.

* * * * *